US007933525B2

(12) United States Patent
Naganawa et al.

(10) Patent No.: US 7,933,525 B2
(45) Date of Patent: Apr. 26, 2011

(54) IMAGE FORMING APPARATUS INCLUDING A CLEANING DEVICE

(75) Inventors: Hiroyuki Naganawa, Kasugai (JP); Masahito Hamaya, Nagoya (JP); Kazushi Fukuta, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 954 days.

(21) Appl. No.: 11/769,983

(22) Filed: Jun. 28, 2007

(65) Prior Publication Data

US 2008/0019723 A1 Jan. 24, 2008

(30) Foreign Application Priority Data

Jun. 30, 2006 (JP) ..... 2006-181781

(51) Int. Cl.
*G03G 15/00* (2006.01)

(52) U.S. Cl. ..... 399/12; 399/71

(58) Field of Classification Search ..... 399/12, 399/71

See application file for complete search history.

(56) References Cited

U.S. PATENT DOCUMENTS

| | | | |
|---|---|---|---|
| 6,519,428 B1 | 2/2003 | Ohtoshi et al. | |
| 6,721,519 B2 * | 4/2004 | Brown | 399/71 |
| 7,187,877 B2 | 3/2007 | Yamaguchi | |

FOREIGN PATENT DOCUMENTS

| | | | |
|---|---|---|---|
| JP | 03233572 A | * | 10/1991 |
| JP | 8-154376 A | | 6/1996 |
| JP | 11352852 | | 12/1999 |
| JP | 2002-116593 A | | 4/2002 |
| JP | 2002-214985 A | | 7/2002 |
| JP | 2004109386 | | 4/2004 |
| JP | 2004-354513 A | | 12/2004 |
| JP | 2004354513 A | * | 12/2004 |
| JP | 2005-189745 A | | 7/2005 |
| JP | 2005202099 | | 7/2005 |
| JP | 2005321558 | | 11/2005 |

OTHER PUBLICATIONS

JP Office Action dtd Jan. 6, 2009, JP Appln. 2006-181781, partial translation.

* cited by examiner

*Primary Examiner* — David M Gray
*Assistant Examiner* — Laura K Roth
(74) *Attorney, Agent, or Firm* — Banner & Witcoff, Ltd.

(57) ABSTRACT

An image forming apparatus includes an object to be cleaned, a cleaning device, a generation device, a control device, a voltage detection device and a load resistance detection device. The cleaning device cleans the object to be cleaned. The generation device generates a cleaning voltage in the cleaning device. The control device controls the generation device thereby to control the cleaning voltage. The voltage detection device detects the cleaning voltage generated in the cleaning device. The load resistance detection device detects a load resistance between the object to be cleaned and the cleaning device, based on at least one control parameter to be used by the control device to control the generation device and the cleaning voltage detected by the voltage detection device.

17 Claims, 11 Drawing Sheets

IMAGE FORMING APPARATUS INCLUDING A CLEANING DEVICE

CROSS-REFERENCE TO RELATED APPLICATIONS

This application claims the benefit of Japanese Patent Application No. 2006-181781 filed Jun. 30, 2006 in the Japanese Patent Office, the disclosure of which is incorporated herein by reference.

TECHNICAL FIELD

The present invention relates to an image forming apparatus that forms an image by transferring a developer onto a recording medium.

BACKGROUND

In a typical known image forming apparatus, an image is formed by transferring a developer (toner) onto a recording medium, such as a recording sheet. An image forming apparatus of this type includes a conveyor belt for conveying the recording medium to an image transfer position.

In some cases, unintended and unnecessary developer adheres to the conveyor belt due to, for example, a sheet jam. In other cases where color printing is performed with a plurality of process cartridges arranged along a conveyance direction of the recording medium, a developer, which is used to form a correction pattern image for adjusting each image forming position of each of the process cartridges (i.e., registration control) and for adjusting a concentration of each of the process cartridges, sometimes adheres to the conveyor belt.

Since the developer not to be used to form a transfer image leads to deterioration of an image quality of a transfer image, the image forming apparatus usually includes a cleaning unit for cleaning the developer adhering to the conveyor belt.

In a typical cleaning unit, a cleaning roller is disposed at a position facing a conveyor belt. A voltage is applied to the cleaning roller to cause a potential difference between the conveyor belt and the cleaning roller, thereby transferring an electrically charged developer on the conveyor belt to the cleaning roller by an electrostatic force. Thus, cleaning (hereinafter also referred to as "bias cleaning") of the conveyor belt is performed.

In this case, feedback control of the voltage applied to the cleaning roller is also performed in order to avoid differences in cleaning performance of the cleaning roller due to changes in using conditions or secular deterioration of the cleaning roller.

It is known that a status of the cleaning unit deteriorates depending on a number of times of use. Specifically, a load resistance between the conveyor belt and the cleaning roller is changed (usually increased) due to, for example, adherence of paper dust to fine pores formed in a surface of the cleaning roller.

However, there has been a problem that deterioration of the status of the cleaning unit due to use (and thus an increase in the load resistance) cannot be accurately specified since the status of the cleaning unit is indirectly specified based on, for example, a number of printed sheets counted by the cleaning unit.

For example, when the cleaning unit is replaced with not a new one but a used one or the like, the status of the cleaning unit indirectly specified based on the number of printed sheets is completely different from an actual status of the cleaning unit. Thus, cleaning is likely to be performed inappropriately.

In view of the possibility that a current flow exceeding a predetermined maximum value may cause damage of the conveyor belt, it is preferable to impose a current limitation. In the cleaning unit, in which voltage control is performed as described above, a separate component for current detection is needed, which leads to an increased size of an image forming apparatus.

SUMMARY

Accordingly, it is desirable to provide an image forming apparatus in which a status of a device (for example, a cleaning roller) that performs bias cleaning of an object to be cleaned can be accurately specified without providing an additional detection circuit or the like.

DETAILED DESCRIPTION

General Overview

The present invention provides an image forming apparatus which includes: an object to be cleaned, a cleaning device, a generation device, a control device, a voltage detection device and a load resistance detection device. The cleaning device cleans the object to be cleaned. The generation device generates a cleaning voltage in the cleaning device. The control device controls the generation device thereby to control the cleaning voltage. The voltage detection device detects the cleaning voltage generated in the cleaning device. The load resistance detection device detects a load resistance between the object to be cleaned and the cleaning device, based on at least one control parameter to be used by the control device to control the generation device and the cleaning voltage detected by the voltage detection device.

According to the image forming apparatus of the present invention, a status of the cleaning device (a number of times of use) may be accurately specified based on the load resistance detected by the load resistance detection device. As a result, it may be possible to obtain advantageous information for replacement of the cleaning device and control of the cleaning voltage.

ILLUSTRATIVE ASPECTS

First Embodiment

[Overall Configuration]

Figure 1:
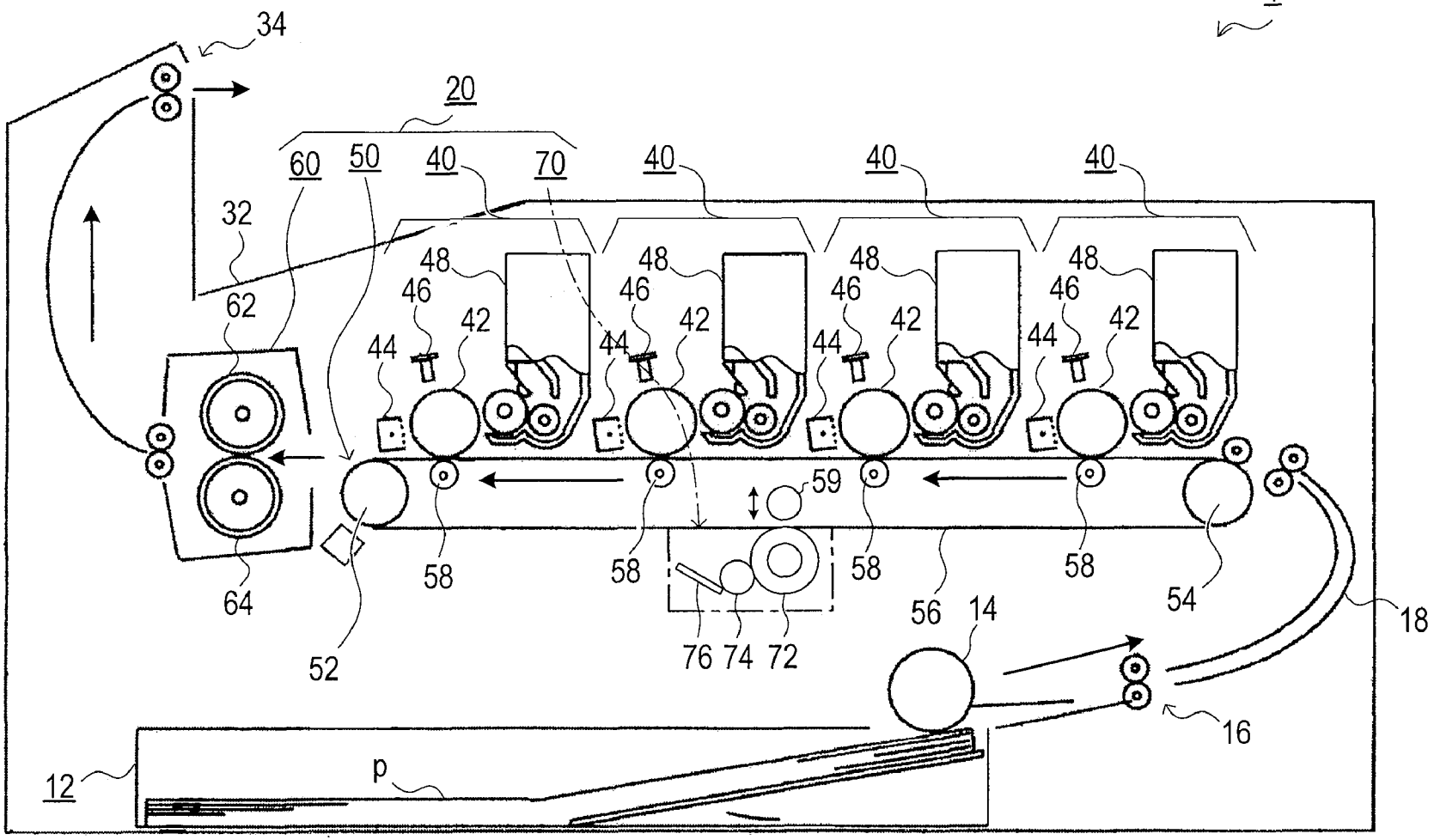
FIG. 1 is a cross-sectional side view showing a schematic structure of a color laser printer.

As shown in FIG. 1, a color laser printer (hereinafter referred to simply as a "printer") 1 includes a sheet tray 12, a sheet feed roller 14, a pair of conveyor rollers 16, a guide path 18, an image forming portion 20, a pair of sheet discharge rollers 34 and a control portion 36 (see FIG. 2).

The sheet tray 12 is attachable and detachable with recording sheets p set therein. The sheet feed roller 14 pulls out the recording sheets p set in the sheet tray 12 sheet by sheet. The pair of conveyor rollers 16 convey a recording sheet p pulled out by the sheet feed roller 14. The guide path 18 guides the recording sheet p conveyed by the conveyor rollers 16. The image forming portion 20 forms an image on the recording sheet p conveyed through the guide path 18. The pair of sheet discharge roller 34 discharge the recording sheet p with the image formed by the image forming portion 20 to a discharge tray 32. The control portion 36 controls all these components.

The image forming portion 20 includes four image forming units 40, a belt unit 50, a fixing unit 60 and an attachable and detachable cleaning unit 70. The image forming units 40 form an image on the recording sheet p. The belt unit 50 conveys the recording sheet p conveyed through the guide path 18 along positions (transfer positions) where image formation is performed by the image forming units 40. The fixing unit 60 heats and presses the image formed on the recording sheet p by the image forming units 40 to fix the image on the recording sheet p. The cleaning unit 70 performs cleaning of the belt unit 50.

The belt unit 50 includes a drive roller 52, a follower roller 54, an endless conveyor belt 56 as an object to be cleaned, transfer rollers 58 and a backup roller 59.

The drive roller 52 is disposed on a downstream side of a conveyance path of the recording sheet p, and is rotated by a drive power of a drive motor (not shown). The follower roller 54 is disposed on an upstream side of the conveyance path of the recording sheet p. The endless conveyor belt 56 is wound around between the drive roller 52 and the follower roller 54. The transfer rollers 58 are disposed at positions so as to face photoconductor drums 42 (described later) constituting the image forming units 40 with the conveyor belt 56 sandwiched therebetween. The backup roller 59 is disposed at a position so as to face a cleaning roller 72 (described later) constituting the cleaning unit 70 with the conveyor belt 56 located therebetween.

A surface of the conveyor belt 56 on which the recording sheet p is placed is referred to as a front surface, while an opposite surface is referred to as a reverse surface. The photoconductor drums 42 and the cleaning roller 72 are disposed so as to abut the front surface of the conveyor belt 56. The transfer rollers 58 and the backup roller 59 are disposed so as to abut the reverse surface of the conveyor belt 56. The backup roller 59 is movable to a position not in contact with the conveyor belt 56 when the cleaning unit 70 is attached or detached, in order to facilitate attachment or detachment of the cleaning unit 70.

The four image forming units 40 are arranged along a conveyance direction of the recording sheet p (see arrows in FIG. 1; hereinafter the same is applicable) by the belt unit 50. Each of the image forming units 40 includes the photoconductor drum 42, a charger 44, an exposure device 46 and a developing unit 48. The charger 44 charges the photoconductor drum 42. The exposure device 46 irradiates a laser beam on a surface of the photoconductor drum 42, which is uniformly charged by the charger 44, thereby to form an electrostatic latent image on the surface of the photoconductor drum 42. The developing unit 48 applies positively charged toner to the electrostatic latent image formed on the surface of the photoconductor drum 42 thereby to form a toner image thereon. It is to be noted that most parts of the exposure device 46 are omitted in FIG. 1 and only a part, through which the laser beam is finally emitted, is shown.

The toner image, which is formed on the photoconductor drum 42 by the charger 44, the exposure device 46 and the developing unit 48, is transferred to the recoding sheet p conveyed by the belt unit 50. The transfer is performed by the transfer roller 58, to which a voltage is applied so as to cause a transfer bias (e.g., −10 μA to −15 μA) between the transfer roller 58 and the photoconductor drum 42. The transfer bias has an opposite polarity (i.e., a negative polarity) to a charged polarity of the toner.

The image forming units 40 are designed to form respective images in different colors (four colors of cyan(C), magenta(M), yellow(Y) and black(K) in the present embodiment). The image forming units 40 are arranged in an order of magenta, cyan, yellow and black from an upstream in the conveyance direction of the recording sheet p by the belt unit 50 (i.e., from a side of the follower roller 54 in FIG. 1).

The fixing unit 60 includes a heating roller 62 and a pressure roller 64 disposed so as to face each other. The heating roller 62 and the pressure roller 64 heat and press the recording sheet p with the transferred toner image while conveying the recording sheet p in a sandwiching manner. As a result, the toner image is fixed on the recording sheet p, and then the recording sheet p is discharged toward the sheet discharge roller 34.

[Configuration of Cleaning Unit]

The cleaning unit 70 constituting a major feature of the present invention includes a cleaning roller 72, a cleaning shaft 74 and a cleaning blade 76. The cleaning roller 72 is disposed so as to contact the front surface of the conveyor belt 56 moving from the drive roller 52 toward the follower roller 54. The cleaning roller 72 removes adhering substances (such as toner and paper dust) adhering to the conveyor belt 56. The cleaning shaft 74 contacts the cleaning roller 72 and conveys the adhering substances adhering to the cleaning roller 72 to a position of a collection container (not shown). The cleaning blade 76 scrapes off the adhering substances adhering to the cleaning shaft 74.

The cleaning roller 72 includes a shaft member made of a conductive material (e.g., an iron material plated with Ni or a stainless steel material) and extending in a width direction of the conveyor belt 56. The shaft member is covered with a foaming material of silicone. The cleaning shaft 74 includes a shaft member made of a conductive material.

The cleaning roller 72 is rotatingly driven in association with the conveyor belt 56 such that a portion in contact with the conveyor belt 56 is moved in a direction reverse to a moving direction of the conveyor belt 56.

Further, when the backup roller 59 facing the cleaning roller 72 with the conveyor belt 56 located therebetween is ground, a first cleaning voltage BCLN1 and a second cleaning voltage BCLN2, each of which has an opposite polarity to a charged polarity of the toner, are applied to the cleaning roller 72 and the cleaning shaft 74, respectively. Specifically, potential differences (electric fields) between the backup roller 59 and the cleaning roller 72, and between the cleaning roller 72 and the cleaning shaft 74 are respectively caused. The potential differences result in an electrostatic force to the toner, and thus the toner is moved from the conveyor belt 56 to the cleaning roller 72 and then from the cleaning roller 72 to cleaning shaft 74. Subsequently, the toner is scraped off by the cleaning blade 76, and thus the cleaning is achieved.

[Configuration of Control System for Cleaning Unit]

Figure 2:
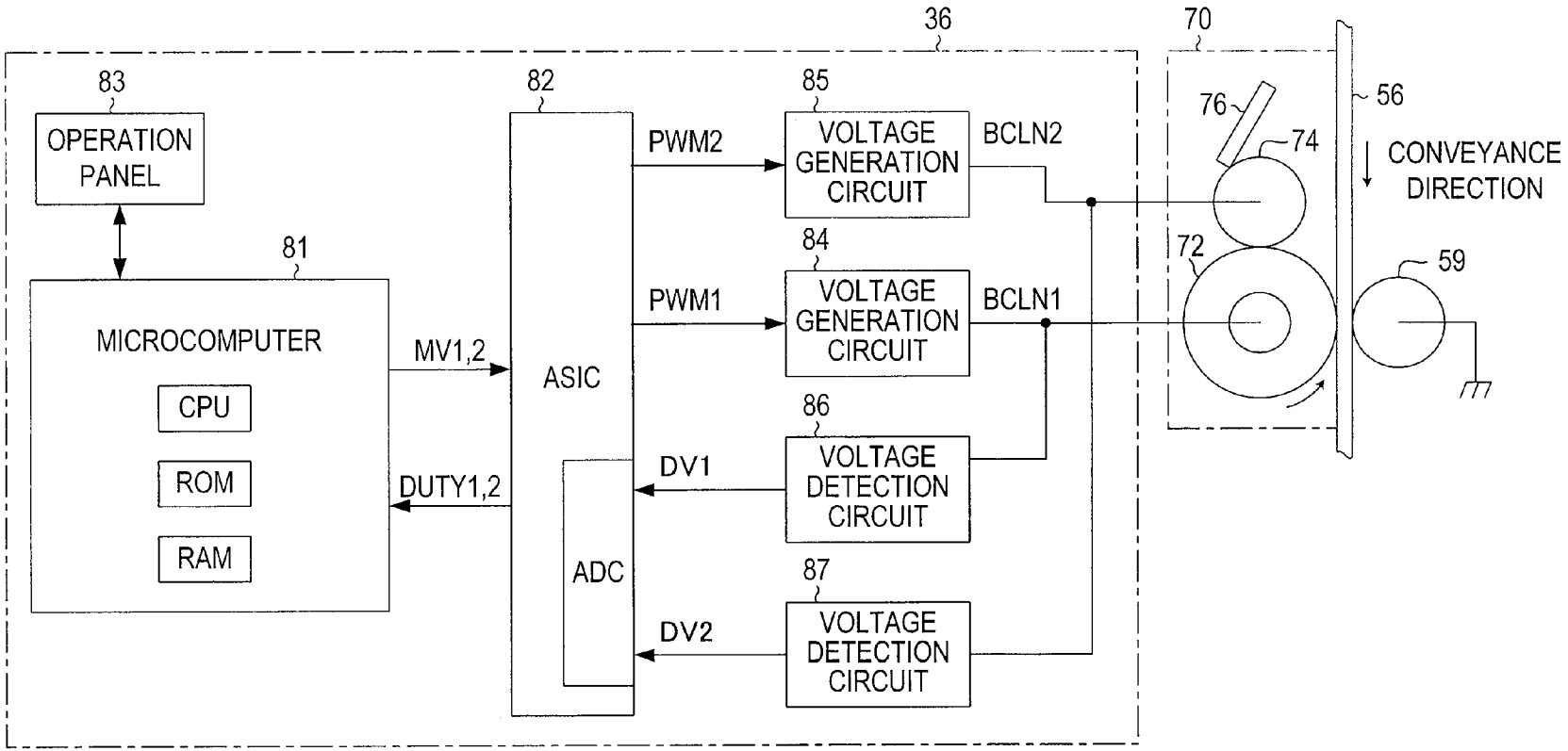
FIG. 2 is a block diagram showing a configuration of a control system regarding a cleaning unit.

FIG. 2 is a block diagram showing a part of the control portion 36 involved in control of the cleaning unit 70.

As shown in FIG. 2, the control portion 36 includes a known microcomputer 81, as a major component, an ASIC 82 and an operation panel 83. The microcomputer 81 includes a CPU, a ROM and a RAM. The ASIC 82 inputs and outputs various signals for controlling the driving of various components of the image forming apparatus. The operation panel 83 includes input keys for inputting various commands and a display panel for displaying various information.

The control portion 36 also includes a voltage generation circuit 84, a voltage generation circuit 85, a voltage detection circuit 86 and a voltage detection circuit 87. The voltage generation circuit 84 supplies power to the cleaning roller 72 thereby to generate the first cleaning voltage BCLN1. The voltage generation circuit 85 supplies power to the cleaning shaft 74 thereby to generate the second cleaning voltage BCLN2. The voltage detection circuit 86 detects an amplitude of the first cleaning voltage BCLN1 generated in the cleaning roller 72. The voltage detection circuit 87 detects an amplitude of the second cleaning voltage BCLN2 generated in the cleaning shaft 74.

The voltage generation circuits 84, 85 are known circuits that are respectively controlled by pulse width modulation (PWM) type control signals PWM1, PWM2 such that output powers supplied to respective objects are controlled depending on duty ratios DUTY1, DUTY2 of the control signals PWM1, PWM2. In other words, amplitudes of the first and second cleaning voltages BCLN1, BCLN2 are determined depending on magnitudes of the powers supplied by the voltage generation circuits 84, 85 (and thus the duty ratios DUTY1, DUTY2) and magnitudes of load resistances of the objects which receive the powers supplied.

The ASIC 82 includes at least a circuit. The circuit performs increase/decrease control of the respective duty ratios DUTY1, DUTY2 of the control signals PWM1, PWM2 at predetermined time intervals (for example, 240 μs) such that when target values MV1, MV2 of the first and second cleaning voltages BCLN1, BCLN2 are set by the microcomputer 81, detected voltages DV1, DV2 detected by the voltage detection circuits 86, 87 are equal to the target values MV1, MV2, respectively. The circuit also notifies the microcomputer 81 of the duty ratios DUTY1, DUTY2 and the detected voltages DV1, DV2 detected by the voltage detection circuits 86, 87.

[Operation of Cleaning Control]

A cleaning process executed by the CPU of the microcomputer 81 will now be described below with reference to the flowcharts in FIGS. 3 to 6. The cleaning process is executed each time the belt unit 50 is activated (i.e., each time rotation of the conveyor belt 56 is started) in order to perform printing on the recording sheet p.

Figure 3:
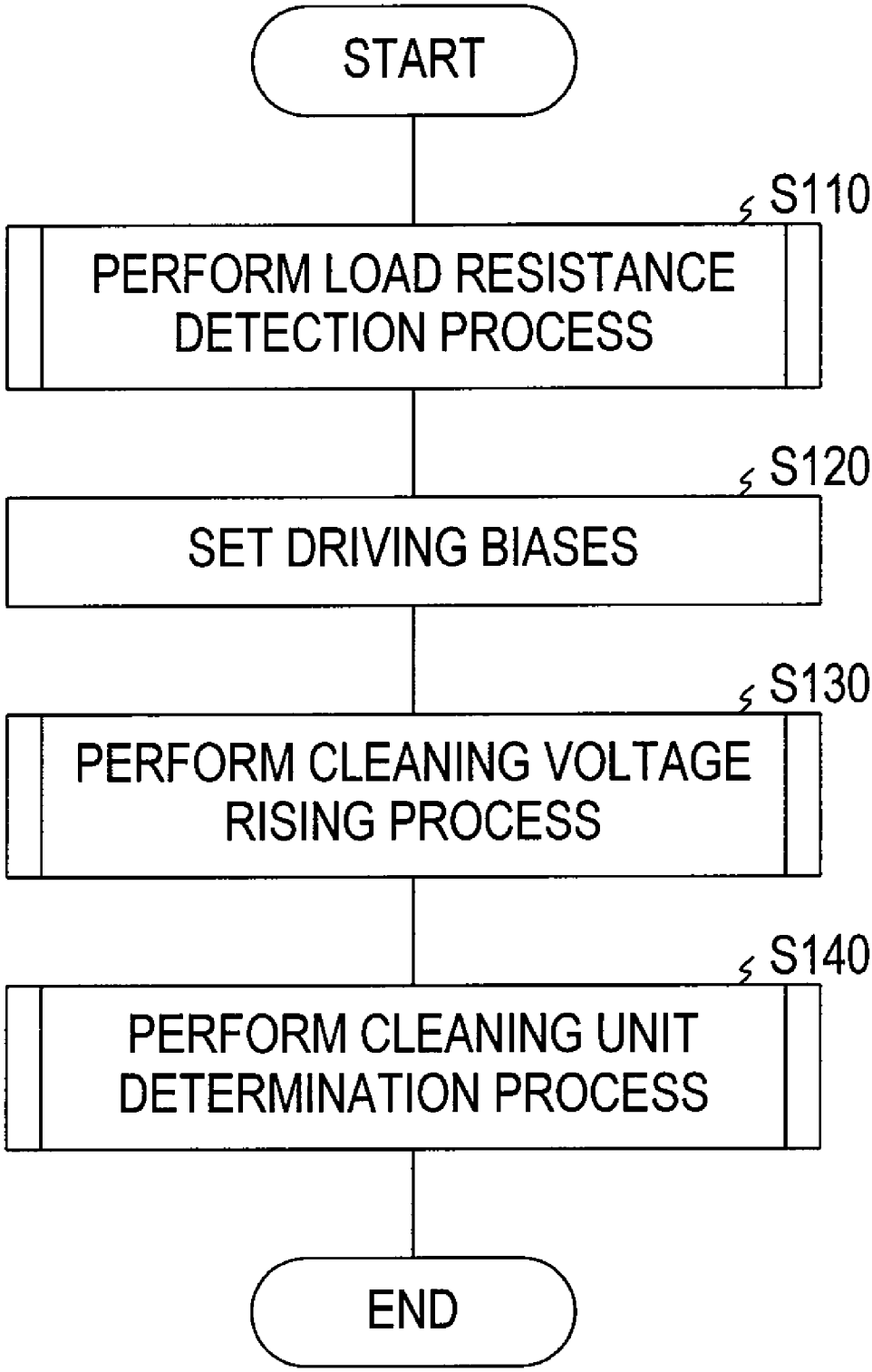
FIG. 3 is a flowchart showing a procedure of a cleaning process.

In the present cleaning process, as shown in FIG. 3, a load resistance detection process to detect a magnitude of a load resistance between the backup roller 59 and the cleaning roller 72 is first performed in S110.

Figure 4:
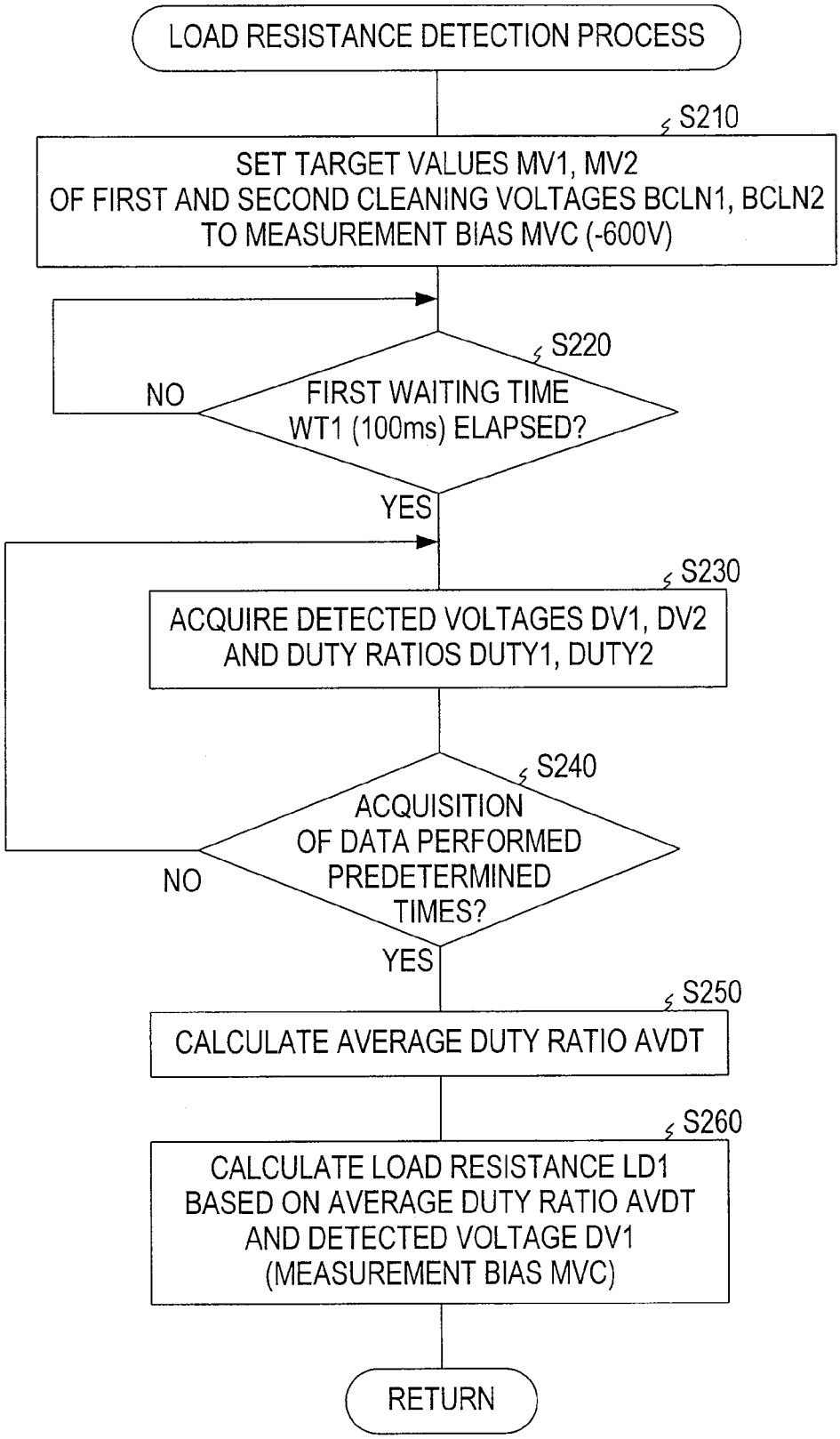
FIG. 4 is a flowchart showing details of a load resistance detection process.

In the load resistance detection process, as shown in FIG. 4, the target value MV1 of the first cleaning voltage BCLN1, and the target value MV2 of the second cleaning voltage BCLN2 are first set, in S210, to a predetermined measurement bias MVC (MVC=−600V in the present embodiment), and then the present process proceeds to S220.

By this, the ASIC 82 controls the duty ratios DUTY1, DUTY2 of the control signals PWM1, PWM2 such that the first and second cleaning voltages BCLN1, BCLN2 are equal to the measurement bias MVC, that is, such that the measurement bias MVC is generated between the backup roller 59 and the cleaning roller 72 and also the cleaning roller 72 and the cleaning shaft 74 have the same electric potential.

In S220, it is determined whether or not a first waiting time WT1 (WT1=100 ms in the present embodiment), from when the target values MV1, MV2 are set to the measurement bias MVC until when the same are stabilized, has elapsed.

When it is determined that the first waiting time WT1 has elapsed, acquisition and storage of duty ratios DUTY1, DUTY2, and detected voltages DV1, DV2 are performed in S230, and then the present process proceeds to S240.

In S240, it is determined whether or not the acquisition of the duty ratios DUTY1, DUTY2, and the detected voltages DV1, DV2 has been performed predetermined times.

When it is determined that the acquisition of the duty ratios DUTY1, DUTY2, and the detected voltages DV1, DV2 has not been performed the predetermined times, the present process returns to S230, and acquisition and storage of the duty ratios DUTY1, DUTY2, and the detected voltages DV1, DV2 are performed repeatedly.

When it is determined that the acquisition has been performed the predetermined times, the present process proceeds to S250.

In S250, an average value AVDT (an average duty ratio AVDT) of a plurality of the duty ratios DUTY1 acquired in S230 is calculated.

In S260, a load resistance LD1 between the backup roller 59 and the cleaning roller 72 is calculated based on the average duty ratio AVDT and the detected voltage DV1 (equal to the measurement bias MVC in a normal state), and then the present process is terminated.

Figure 7A:
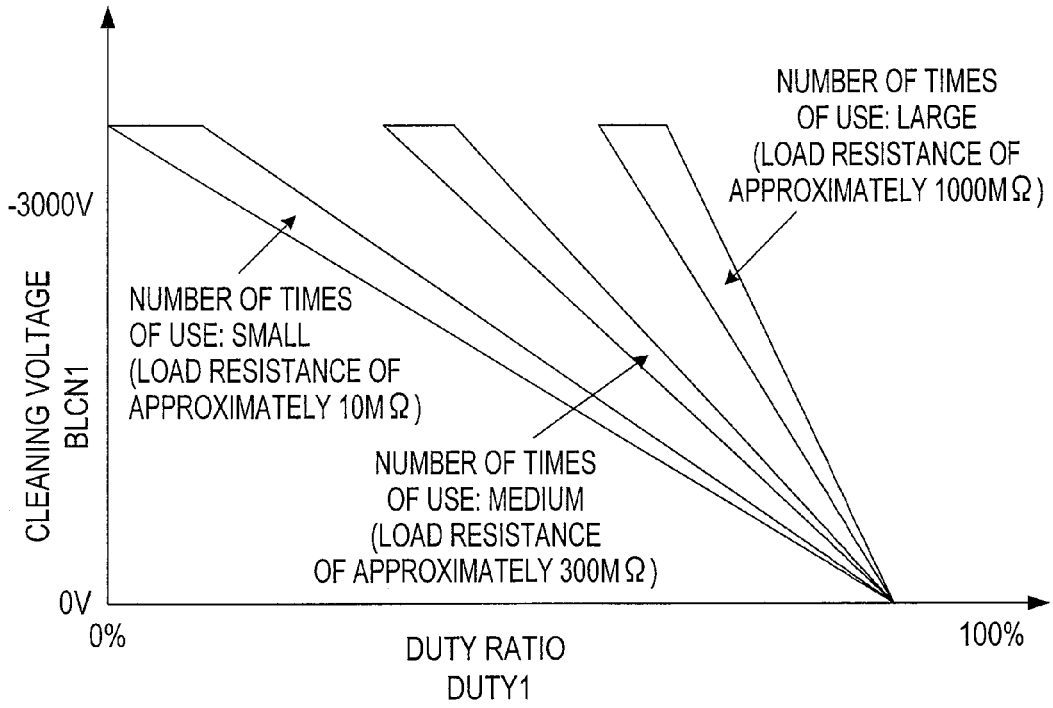
FIG. 7A is a graph showing a relationship between a duty ratio DUTY1 of a control signal PWM1 and a first cleaning voltage BCLN1 regarding each load resistance between a backup roller and a cleaning roller.

There is a relationship between the duty ratio DUTY1 of the control signal PWM1 and the first cleaning voltage BCLN1 (and thus the detected voltage DV1) as shown in FIG. 7A. Specifically, in a case of a constant load resistance LD1, as the duty ratio DUTY1 becomes increased, an absolute value of the first cleaning voltage BCLN1 becomes decreased. On condition that the relationship between the duty ratio DUTY1 and the first cleaning voltage BCLN1 with the constant load resistance LD1 is expressed by a linear line, an inclination of the linear line becomes steeper as the load resistance LD1 becomes larger. In FIG. 7A, however, the inclination is indicated with a certain range in view of characteristic variations in each cleaning unit 70.

Accordingly, when the relationship between the inclination and the load resistance LD1 is previously stored in the form of a table or the like in the ROM of the microcomputer 81, a magnitude of the load resistance LD1 (and thus an after-mentioned number of times of use of the cleaning roller 72) can be calculated based on the average duty ratio AVDT and the detected voltage DV1. The detected voltage DV1 used in S260 may be selected from a plurality of acquired detected voltages DV1, or may be an average of the plurality of acquired detected voltages DV1 the same as in the case of the duty ratio, for use to specify the load resistance LD1.

Returning to FIG.3, in S120, a process to determine first and second driving biases MVD1, MVD2 (having negative polarity and an absolute value larger than 200V in the present embodiment) based on the load resistance LD1 detected in S110 is performed. The first and second driving biases MVD1, MVD2 are target values MV1, MV2 of the first and second cleaning voltages BCLN1, BCLN2 to be set at the time of actually performing printing.

Figure 7B:
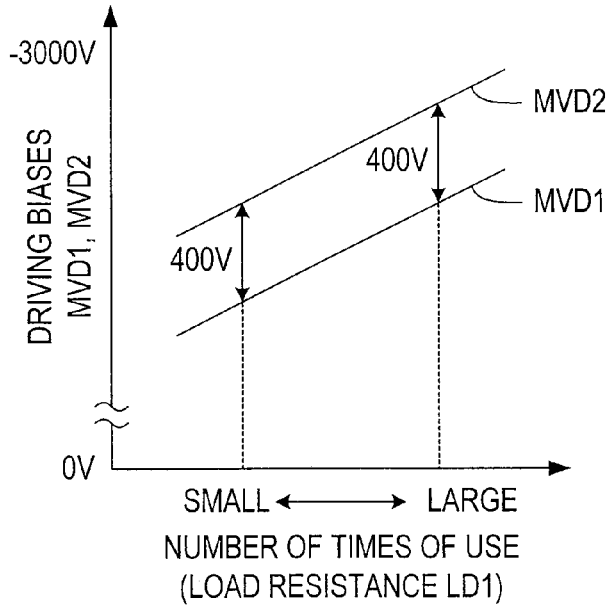
FIG. 7B is graph showing a relationship between a first driving bias MVD1 and a second driving bias MVD2.

Specifically, a first cleaning voltage BCLN1 which causes an absolute value of a load current flowing through the load resistance LD1 to be a predetermined maximum value (e.g., 10 μA) is determined as a first driving bias MVD1. Then, a second driving bias MVD2 is determined by adding a predetermined voltage (−400V in the present embodiment) to the first driving bias MVD1. Accordingly, absolute values of the first and second driving biases MVD1, MVD2 become increased as a number of times of use of the cleaning unit 70 (and thus the load resistance LD1) becomes increased, as shown in FIG. 7B.

In S130, a cleaning voltage rising process is performed. In the cleaning voltage rising process, target values MV1, MV2 of the first and second cleaning voltages BCLN1, BCLN2 are increased in a step-wise manner to the first and second driving biases MVD1, MVD2 determined in S120.

In S140, a cleaning unit determination process is performed. In the cleaning unit determination process, it is determined whether or not the cleaning unit 70 is in an attached state and whether or not replacement of the cleaning unit 70 has been performed based on the magnitude of the load resistance LD1 calculated in S110. Then, the present process is terminated.

Figure 5:
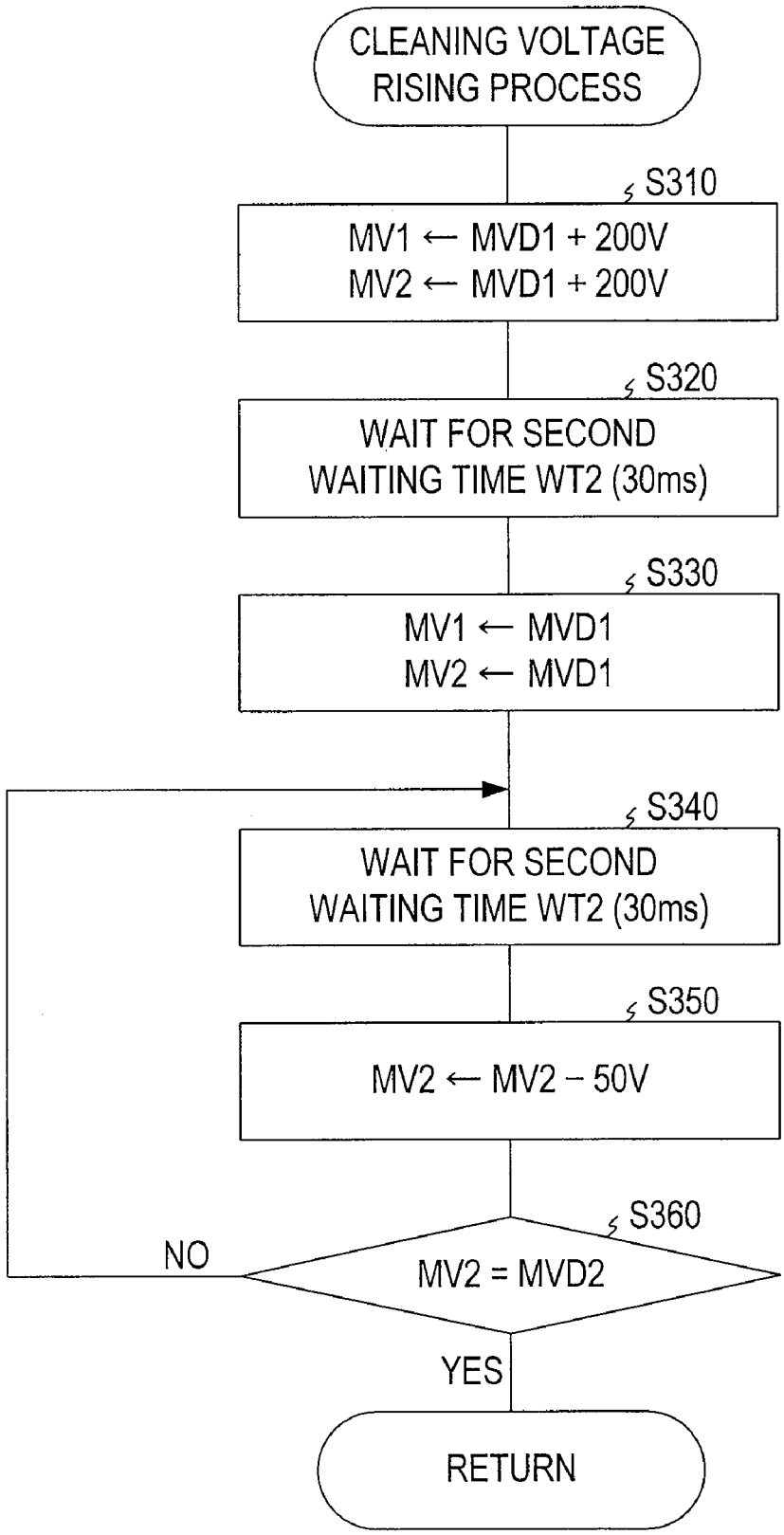
FIG. 5 is a flowchart showing details of a cleaning voltage rising process.

In the cleaning voltage rising process performed in S130, the target values MV1, MV2 of the first and second cleaning voltages BCLN1, BCLN2 are set to a value (MVD1+200V) which is smaller in the absolute value than the first driving bias MVD1 set in S120 by a predetermined voltage (200V in the present embodiment), as shown in FIG. 5.

In S320, the present process waits for the second waiting time WT2 (WT2=30 ms in the present embodiment).

In S330, both of the target values MV1, MV2 of the first and second cleaning voltages BCLN1, BCLN2 are changed to the first driving bias MVD1.

Subsequently, in S340, the present process waits again for the second waiting time WT2.

In S350, the target value MV2 of the second cleaning voltage BCLN2 is changed to a value (MV2 −50V) which is larger in the absolute value than a current value MV2 by a predetermined voltage (50V in the present embodiment).

In S360, it is determined whether or not the target value MV2 set in S350 has reached the second driving bias MVD2. When it is determined that the target value MV2 has not reached the second driving bias MVD2, the present process returns to S340, and the processings from S340 to S360 are repeatedly performed. When it is determined that the target value MV2 has reached the second driving bias MVD2, the present process is terminated.

Figure 8:
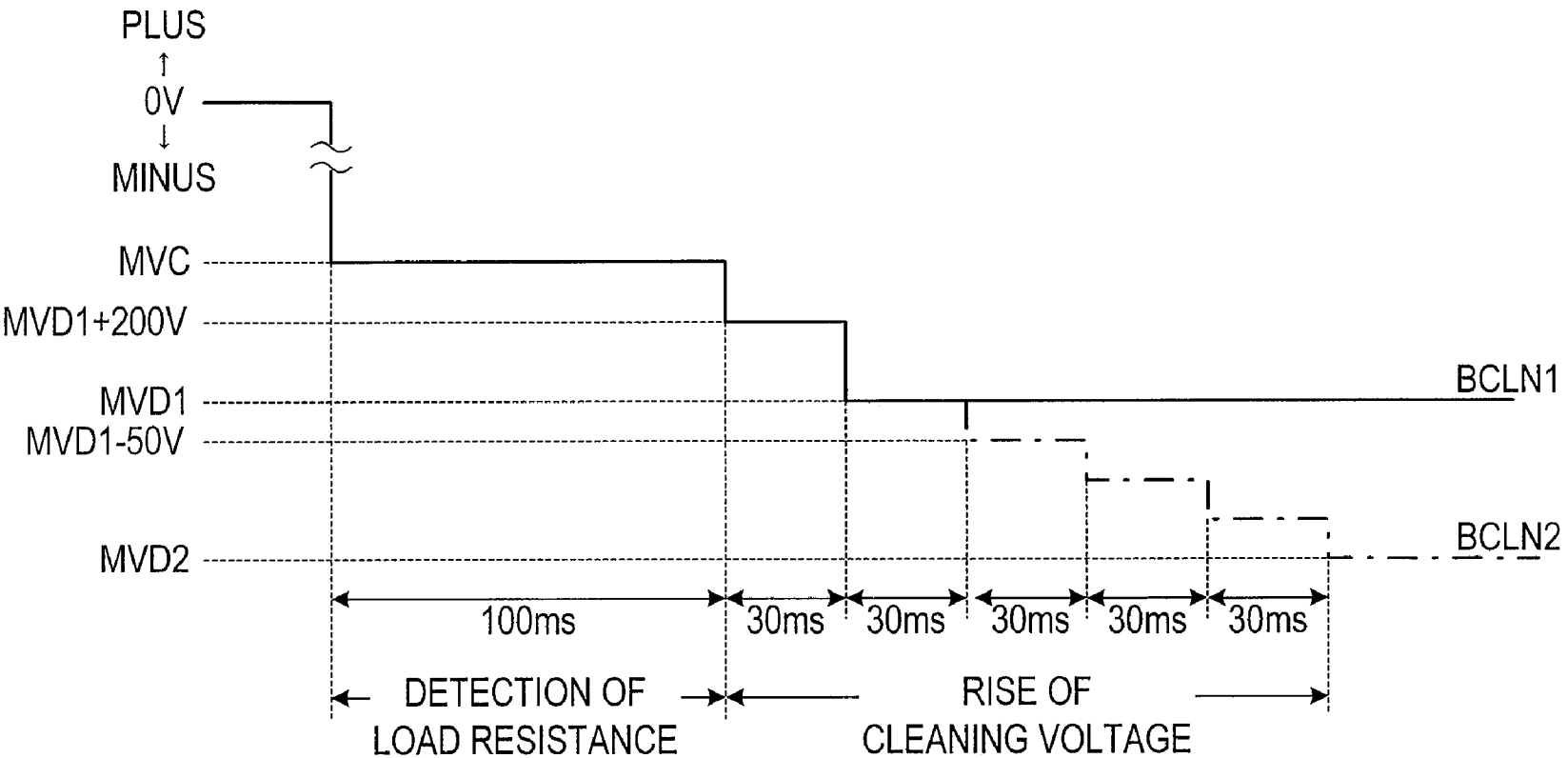
FIG. 8 an explanatory view showing a state of changes of the first cleaning voltage BCLN1 and a second cleaning voltage BCLN2 during the cleaning process.

That is, according to the cleaning voltage rising process, the first cleaning voltage BCLN1 is risen at three steps of the measurement bias MVC, the first driving bias MVD1+200V and the first driving bias MVD1, as indicated by a solid line in FIG. 8. The second cleaning voltage BCLN2 is risen so as to reach the first driving bias MVD1 and subsequently approach the second driving bias MVD2 in the step-wise manner by −50V each time the second waiting time WT2 elapses, as indicated by an alternate long and short dash line in FIG. 8 (FIG. 8 shows an example in which the difference between the first cleaning voltage BCLN1 and the second cleaning voltage BCLN2 is 200V).

Figure 6:
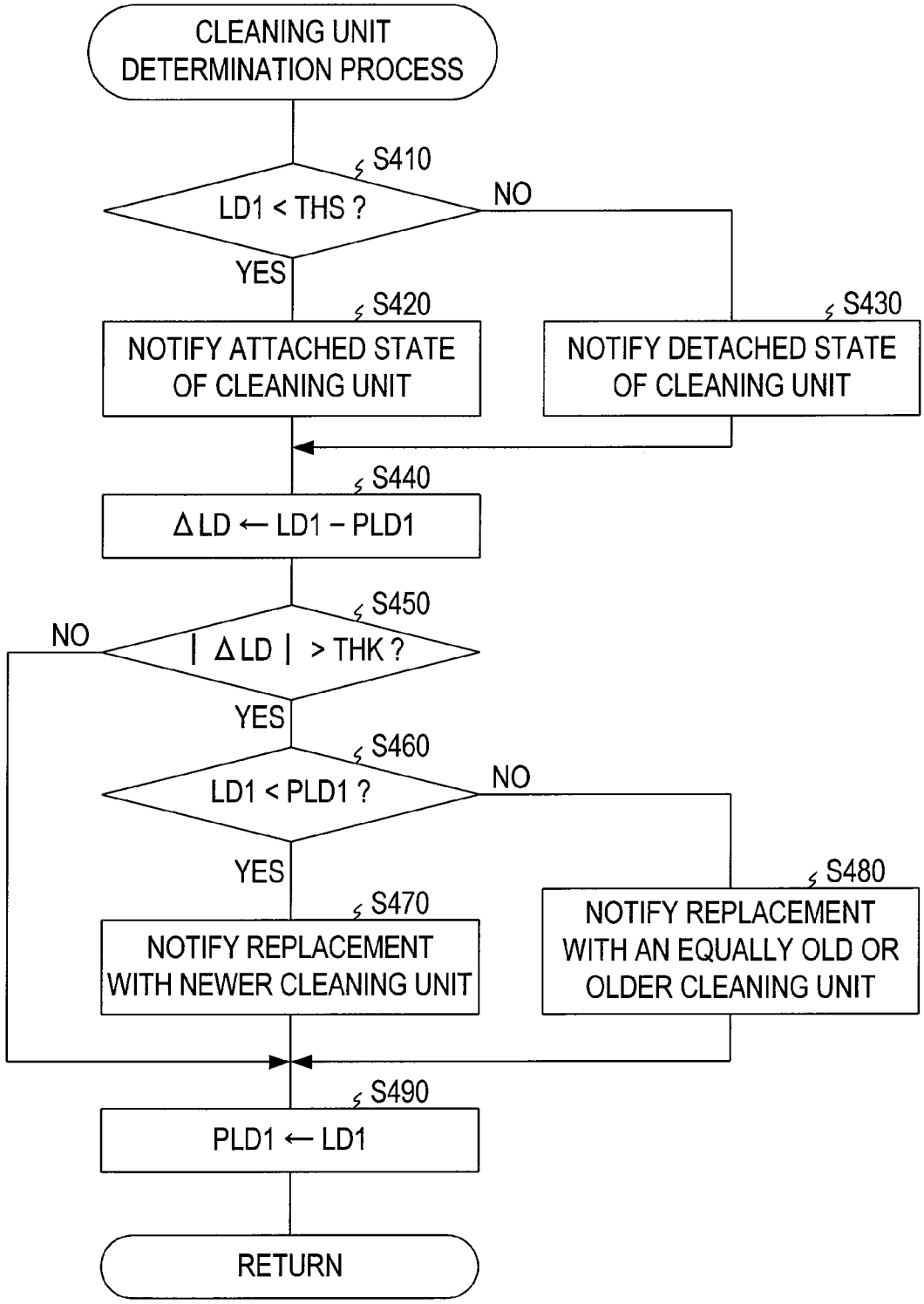
FIG. 6 is a flowchart showing details of a cleaning unit determination process.

The above-described cleaning unit determination process in S140 will be further described referring to FIG. 6. It is first determined in S410, whether or not the load resistance LD1 detected in S110 is smaller than a predetermined attachment resistance value THS.

When it is determined that the load resistance LD1 detected in S110 is smaller than the attachment resistance value THS, the cleaning unit 70 is determined to be in an attached state, and the determination is notified by the operation panel 83 in S420.

When it is determined that the load resistance LD1 is equal to or larger than the attachment resistance value THS, the cleaning unit 70 is determined to be in a detached state (in a non-attached state), and the determination is notified by the operation panel 83 in S430.

Then, the present process proceeds to S440. In S440, a change value ΔLD of the load resistance is calculated by subtracting a load resistance (a previous detected value) PLD1, which is detected when the present process is performed previously and is to be stored in a later-described S490, from a load resistance (a current detected value) LD1, which is detected when the present process is performed currently.

In S450, it is determined whether or not an absolute value |ΔLD| of the change value calculated in S440 is larger than a predetermined exchange resistance THK. When it is determined that the absolute value |ΔLD| of the change value is equal to or smaller than the exchange resistance THK, it is regarded that replacement of the cleaning unit 70 has not been performed, and the present process proceeds to S490. When it is determined that the absolute value |ΔLD| of the change value is larger than the exchange resistance THK, it is regarded that replacement of the cleaning unit 70 has been performed, and the present process proceeds to S460.

In S460, comparison between the current detected value LD1 and the previous detected value PLD1 is performed. When it is determined that the current detected value LD1 is smaller than the previous detected value PLD1, it is regarded that the cleaning unit 70 has been replaced with a newer one than before the replacement. Then, replacement with a newer one is notified by the operation panel 83 in S470. In contrast, when it is determined that the current detected value LD1 is equal to or larger than the previous detected value PLD1, it is regarded that the cleaning unit 70 has been replaced with an equally old or older one. Then, replacement with an equally old or older one is notified by the operation panel 83 in S480. Subsequent to S470 or S480, the present process proceeds to S490.

Finally, in S490, the previous detected value PLD1 is updated by the current detected value LD1, and the present process is terminated.

[Advantageous Effects]

As described above, the printer 1 is configured such that the load resistance LD1 between the backup roller 59 and the cleaning roller 72 is detected based on the duty ratio DUTY1 of the control signal PWM1 that controls the output of the voltage generation circuit 84, and on the detected voltage DV1 of the first cleaning voltage BCLN1 actually generated to the cleaning roller 72.

The load resistance LD1 is gradually increased in accordance with the number of times of use of the cleaning unit 70 (particularly the cleaning roller 72). When the cleaning unit 70 is in a detached state, the load resistance LD1 is extremely increased (usually infinitely large) since a conduction state is not achieved. When the cleaning unit 70 is replaced, a drastic change of the load resistance LD1 that is impossible in a normal state of use occurs. As described above, the load resistance LD1 may properly reflect a state of the cleaning unit 70.

According to the printer 1, it may, therefore, be possible to appropriately perform setting of the driving biases MVD1, MVD2 and determination of an attached/detached state and presence/absence of replacement of the cleaning unit 70 based on the detected load resistance LD1, and to notify determination results to a user.

According to the printer 1, the load resistance LD1 is calculated based on the duty ratio DUTY1, which is one of control parameters used also in a prior art apparatus, and the detected voltage DV1 (the measurement bias MVC) instead of detecting a current flowing between the backup roller 59 and the cleaning roller 72. Accordingly, the above-described advantageous effects may be achieved without providing an additional detection circuit, and the present configuration may be easily applied to a prior art apparatus.

According to the printer 1, it is determined whether or not replacement of the cleaning unit 70 has been performed. It is also determined whether or not the replaced cleaning unit 70 is a newer one than before the replacement. These determinations are notified to a user. Thus, an improved user's convenience may be achieved.

According to the printer 1, the determinations of an attached/detached state and presence/absence of replacement of the cleaning unit 70 are performed based on the changes in the load resistance LD1. Since it is unnecessary to provide any separate dedicated detection circuit for the determinations, a simplified apparatus configuration may be achieved.

According to the printer 1, the driving biases MVD1, MVD2 are set such that the current flowing between the backup roller 59 and the cleaning roller 72, i.e., the current flowing through the conveyor belt 56, is equal to or smaller than a predetermined value. Accordingly, even when the load resistance is substantially small (for example, when the cleaning roller 72 is replaced with a new one), an excess current flow through the conveyor belt 56 may be prevented. Thus, it may be possible to prevent damage of the cleaning roller 72 or the conveyor belt 56 due to an excessive current flow.

Since the driving biases MVD1, MVD2 are set considering a load current as described above, it is unnecessary to insert a resistor for current limitation in a closed circuit for generating the first and second cleaning voltages BCLN1, BCLN2 to the cleaning roller 72 and the cleaning shaft 74, respectively. Accordingly, a simplified circuit configuration may be achieved.

According to the printer 1, when the first and second cleaning voltages BCLN1, BCLN2 are increased, the target values MV1, MV2 are not set directly to the first and second driving biases MVD1, MVD2, but set to approach the first and second driving biases MVD1, MVD2 in a step-wise manner. Accordingly, it may be possible to surely prevent an instantaneous excessive current from flowing through the cleaning roller 72 and the conveyor belt 56 at the time of the increase of the first and second cleaning voltages BCLN1, BCLN2.

Second Embodiment

A description of a second embodiment of the present invention will now be provided below.

In the second embodiment, only differences from the first embodiment are a configuration of a voltage generation circuit 90 provided instead of the voltage generation circuits 84, 85, and a procedure of the cleaning voltage rising process. The description will, therefore, be provided mainly regarding the differences.

Figure 9:
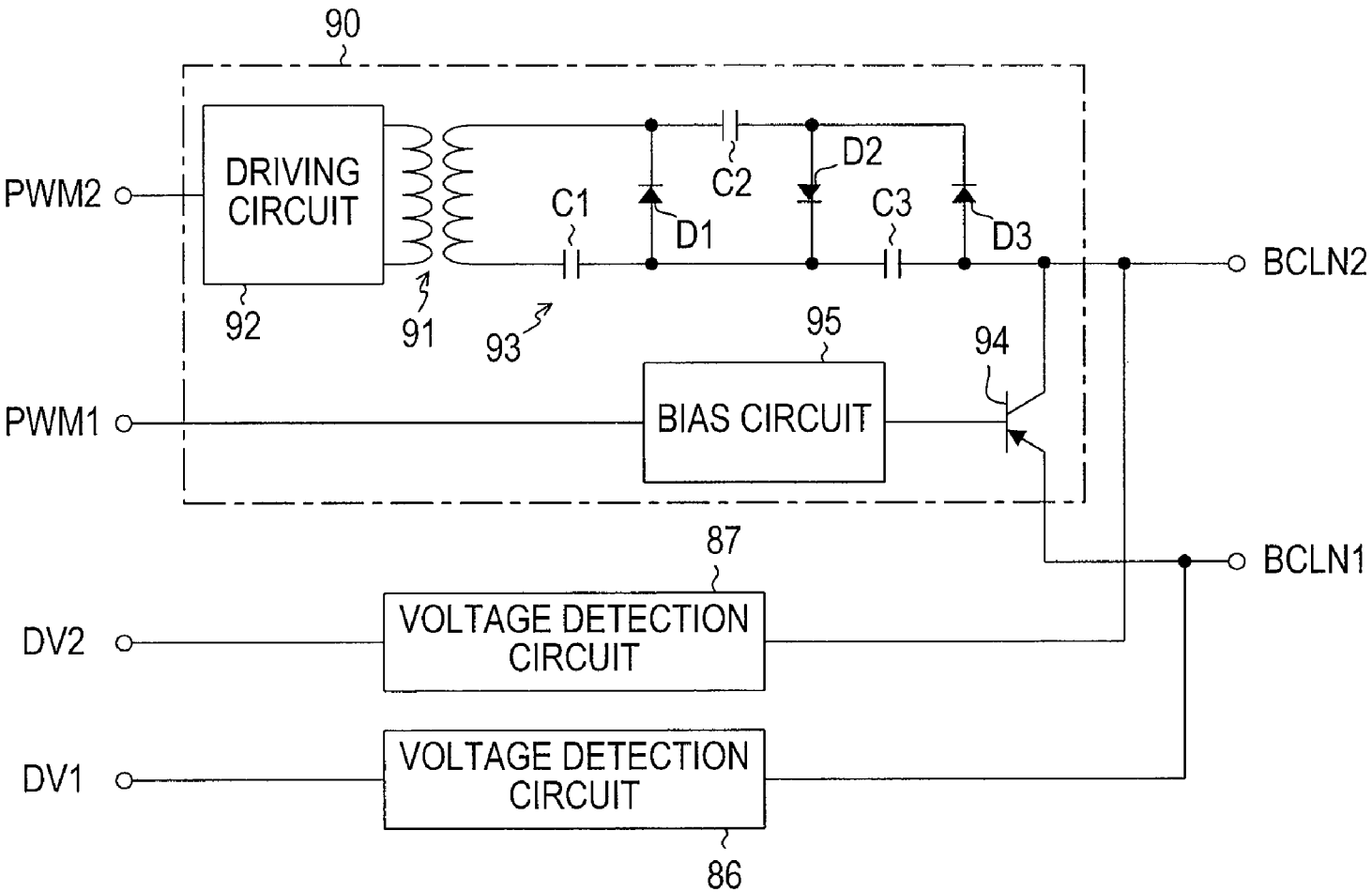
FIG. 9 a circuit diagram partially including a block diagram, showing a configuration of a voltage generation circuit in a second embodiment.

FIG. 9 is a circuit diagram, partially including a block diagram, showing the configuration of the voltage generation circuit 90 that generates the first and second cleaning voltages BCLN1, BCLN2.

As shown in FIG. 9, the voltage generation circuit 90 includes a transformer 91, a driving circuit 92, a booster circuit 93, a transistor 94 and a bias circuit 95. The driving circuit 92 performs intermittent control of a current flowing through a primary coil of the transformer 91 in accordance with the control signal PWM2 provided by the ASIC 82. The booster circuit 93, including condensers C1-C3 and diodes D1-D3, boosts a voltage induced in a secondary coil of the transformer 91 and supplies the boosted voltage to an output end of the second cleaning voltage BCLN2. The transistor 94 is provided in a path connecting an output of the booster circuit 93 and an output end of the first cleaning voltage BCLN1. The bias circuit 95 smoothes the control signal PWM1 supplied by the ASIC 82 to generate a bias voltage for driving the transistor 94.

That is, the first cleaning voltage BCLN1 is generated by bucking the second cleaning voltage BCLN2.

Figure 10:
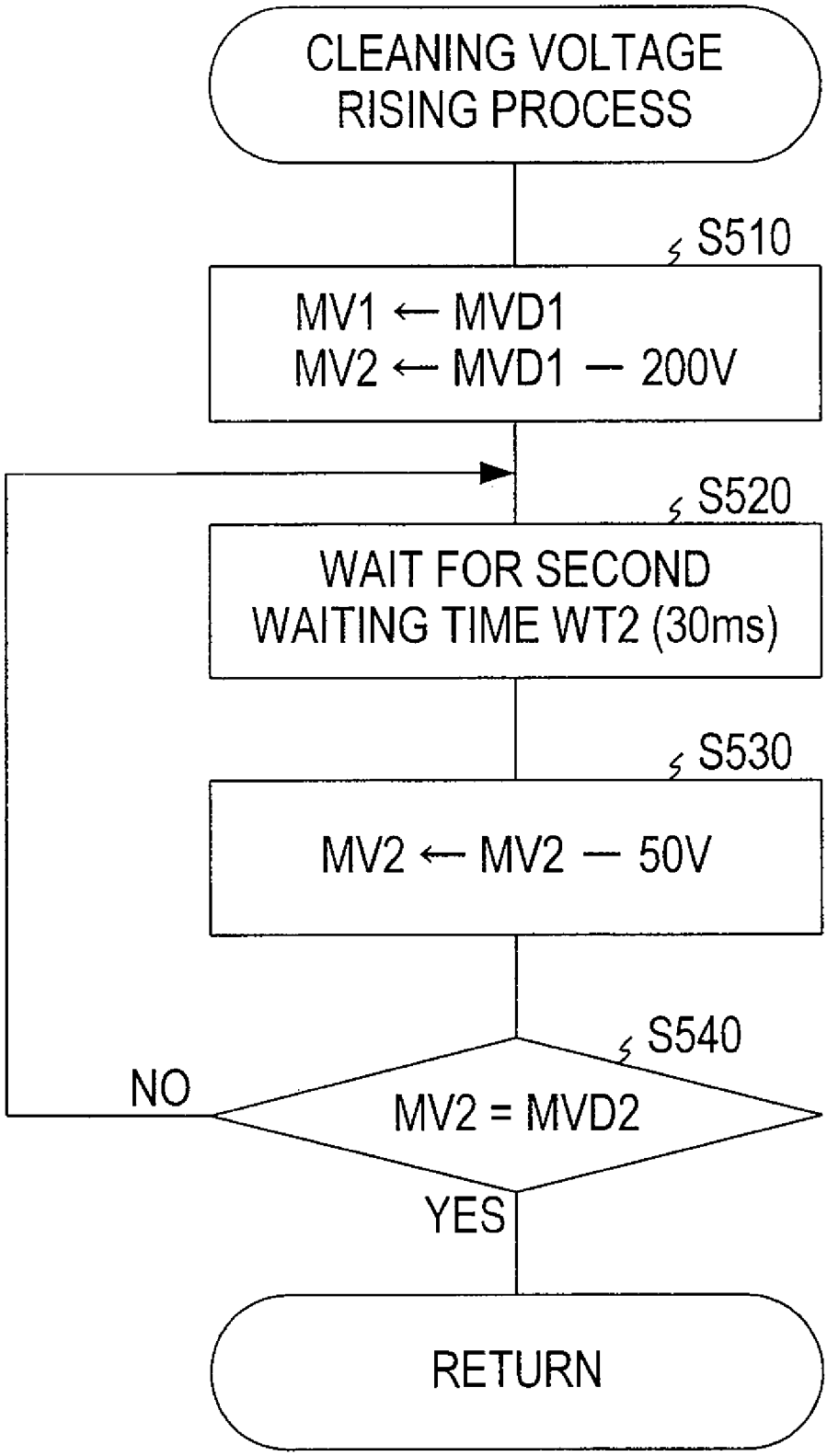
FIG. 10 is a flowchart showing details of a procedure of a cleaning voltage rising process in the second embodiment.

A cleaning voltage rising process will now be described with reference to FIG. 10. As shown in FIG. 10, the target value MV1 of the first cleaning voltage BCLN1 is first set, in S510, to the first driving bias MVD1 set in S120. The target value MV2 of the second cleaning voltage BCLN2 is set to a value (MVD1 −200V) having an absolute value which is larger than the first driving bias MVD1 by a predetermined voltage (200V in the present embodiment).

In S520, the process waits for the second waiting time WT2 (WT2=30 ms in the present embodiment).

In S530, the target value MV2 of the second cleaning voltage BCLN2 is changed to a value (MV2 −50V) having an absolute value which is larger than the current target value MV2 by a predetermined voltage (50V in the present embodiment).

In S540, it is determined whether or not the target value MV2 set in S530 has reached the second driving bias MVD2.

When it is determined that the target value MV2 has not reached the second driving bias MVD2, the present process returns to S520, and the processings in S520 to S540 are repeatedly performed. When it is determined that the target value MV2 has reached the second driving bias MVD2, the present process is terminated.

Figure 11B:
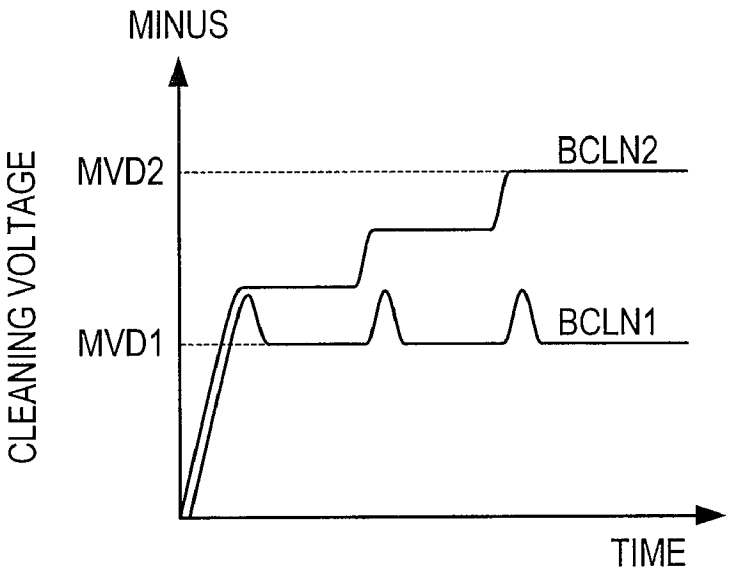
FIGS. 11A and 11B are graphs showing changes in the first cleaning voltage BCLN1 and a second cleaning voltage BCLN2 in the cleaning voltage rising process.
Figure 11A:
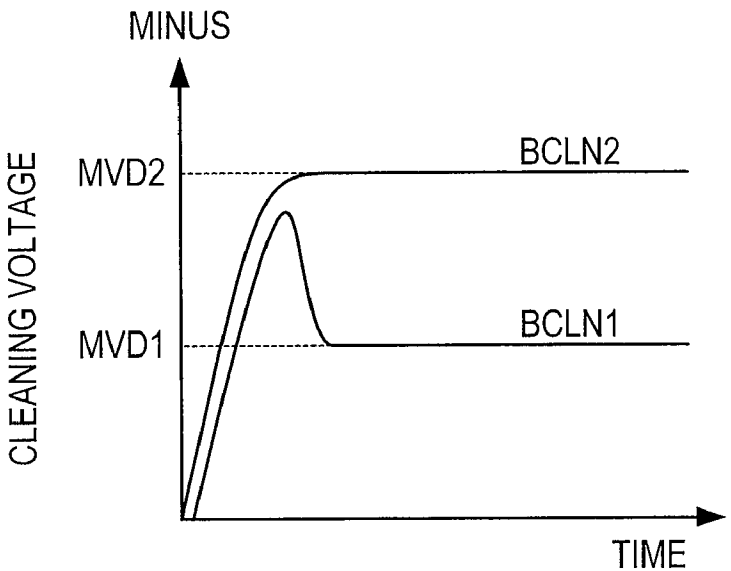

When the second cleaning voltage BCLN2 is rapidly risen to the second driving bias MVD2, the first cleaning voltage BCLN1 is also rapidly risen following the second cleaning voltage BCLN2 and then is converged to the first driving bias MVD1 as the target value MV1, as shown in FIG. 11A, due to the characteristics of the voltage generation circuit 90. Accordingly, a large amount of the first cleaning voltage BCLN1 (an excessive voltage) exceeding the first driving bias MVD1 is instantaneously generated to the cleaning roller 72, and thereby an excessive current flows through the cleaning roller 72 and the conveyor belt 56.

According to the printer 1 of the present embodiment, in contrast, the second cleaning voltage BCLN2 is risen in a step-wise manner, and thus an excess amount from the first driving bias MVD1 generated at the time of rise of the second cleaning voltage BCLN2 may be suppressed. Accordingly, it may be possible to prevent an excessive current from flowing through the cleaning roller 72 and the conveyor belt 56.

Other Embodiments

Although the preferred embodiments of the present invention have been described above, it will be understood that the present invention should not be limited to the above embodiments but may be embodied in various forms without departing from the spirit and scope of the present invention.

For example, while an object to be cleaned is the conveyor belt 56 in the above described embodiments, the object to be cleaned may be the photoconductor drum 42. In a case where the guide path 18 to guide the recording sheet p is constituted by a conveyor belt, the object to be cleaned may be the conveyor belt.

In the above described embodiments, voltage generation circuits are configured such that the output powers are controlled based on the duty ratios DUTY1, DUTY2 of the control signals PWM1, PWM2. However, when the output powers are controlled based on a signal level of a control signal constituted by a base band signal, voltage generation circuits may be configured such that the load resistance LD1 is calculated based on the signal level instead of the duty ratios DUTY1, DUTY2.

In the above described embodiments, there is a relationship between the duty ratio DUTY1 and the first cleaning voltage BCLN1 such that as the duty ratio DUTY1 becomes larger, the absolute value of the first cleaning voltage BCLN1 becomes smaller. However, there may be a relationship such that as the duty ratio DUTY1 becomes larger, the absolute value of the first cleaning voltage BCLN1 becomes larger.

In the above described embodiments, the first and second cleaning voltages BCLN1, BCLN2 have a negative polarity since the toner has a positive polarity. However, the first and second cleaning voltages BCLN1, BCLN2 may have a positive polarity when the toner has a negative polarity.

In the above described embodiments, the cleaning unit determination process (S140) is performed after the cleaning voltage rising process (S130). However, the cleaning unit determination process may be performed at any timing after the load resistance detection process (S110) is preformed.

In the above described embodiments, the duty ratios DUTY1, DUTY2 are controlled such that the detected voltages DV1, DV2 are equal to the target values MV1, MV2. However, the duty ratios DUTY1, DUTY2 may be controlled in accordance with a predetermined rule instead of the detected voltages DV1, DV2.

What is claimed is:

1. An image forming apparatus, comprising:

an object to be cleaned;

a cleaning device that cleans the object to be cleaned;

a generation device that generates a cleaning voltage in the cleaning device;

a control device that controls the generation device to control the cleaning voltage;

a voltage detection device that detects the cleaning voltage generated in the cleaning device;

a load resistance detection device that detects a load resistance between the object to be cleaned and the cleaning device, based on at least one control parameter to be used by the control device to control the generation device and the cleaning voltage detected by the voltage detection device; and a setting device that sets, based on the load resistance detected by the load resistance detection device, a target cleaning voltage which is a voltage to be generated in the cleaning device when the object to be cleaned is cleaned by the cleaning device, wherein the control device controls the cleaning voltage generated by the generation device such that the cleaning voltage detected by the voltage detection device is equal to a target value, and wherein the setting device sets the target cleaning voltage such that an absolute value of a current flowing through the cleaning device calculated based on the cleaning voltage detected by the voltage detection device and the load resistance detected by the load resistance detection device is equal to or smaller than a predetermined maximum value.

2. The image forming apparatus according to claim 1, wherein the generation device supplies power to the cleaning device to generate the cleaning voltage, and wherein the control device controls the power supplied by the generation device to the cleaning device to control the cleaning voltage generated in the cleaning device.

3. The image forming apparatus according to claim 1, further including a determination device that determines that the cleaning device is in an attached state when the load resistance detected by the load resistance detection device is smaller than a predetermined resistance value, and determines that the cleaning device is in a detached state when the load resistance is larger than the predetermined resistance value.

4. The image forming apparatus according to claim 3, further including a notification device that notifies an attached/detached state of the cleaning device determined by the determination device.

5. The image forming apparatus according to claim 1, further including a determination device that determines that replacement of the cleaning device has been performed when a change between the load resistance detected by the load resistance detection device and a previous load resistance detected by the load resistance detection device at a previous time is larger than a predetermined amount.

6. The image forming apparatus according to claim 5, further including a notification device that notifies a determination result by the determination device.

7. The image forming apparatus according to claim 5, wherein the determination device determines that replacement with a newer cleaning device than before the replacement has been performed when the load resistance detected by the load resistance detection device is smaller than the previous load resistance, and determines that replacement with an older cleaning device than before the replacement has been performed when the load resistance is larger than the previous load resistance.

8. The image forming apparatus according to claim 1, wherein the object to be cleaned is a belt that conveys a recording medium.

9. The image forming apparatus according to claim 1, further including a target setting device that sets the target value such that the cleaning voltage approaches the target cleaning voltage in a step-wise manner.

10. An image forming apparatus, comprising:

an object to be cleaned;

a cleaning device that cleans the object to be cleaned;

a generation device that generates a cleaning voltage in the cleaning device;

a control device that controls the generation device to control the cleaning voltage;

a voltage detection device that detects the cleaning voltage generated in the cleaning device, wherein the control device controls the cleaning voltage generated by the generation device such that the cleaning voltage detected by the voltage detection device is equal to a target value;

a load resistance detection device that detects a load resistance between the object to be cleaned and the cleaning device, based on at least one control parameter to be used by the control device to control the generation device and the cleaning voltage detected by the voltage detection device;

a setting device that sets, based on the load resistance detected by the load resistance detection device, a target cleaning voltage which is a voltage to be generated in the cleaning device when the object to be cleaned is cleaned by the cleaning device; and a target setting device that sets the target value such that the cleaning voltage approaches the target cleaning voltage in a step-wise manner.

11. The image forming apparatus according to claim 10, wherein the generation device supplies power to the cleaning device to generate the cleaning voltage, and wherein the control device controls the power supplied by the generation device to the cleaning device to control the cleaning voltage generated in the cleaning device.

12. The image forming apparatus according to claim 10, further including a determination device that determines that the cleaning device is in an attached state when the load resistance detected by the load resistance detection device is smaller than a predetermined resistance value, and determines that the cleaning device is in a detached state when the load resistance is larger than the predetermined resistance value.

13. The image forming apparatus according to claim 12, further including a notification device that notifies an attached/detached state of the cleaning device determined by the first determination device.

14. The image forming apparatus according to claim 10, further including a determination device that determines that replacement of the cleaning device has been performed when a change between the load resistance detected by the load resistance detection device and a previous load resistance detected by the load resistance detection device at a previous time is larger than a predetermined amount.

15. The image forming apparatus according to claim 14, further including a notification device that notifies a determination result by the determination device.

16. The image forming apparatus according to claim 14, wherein the determination device determines that replacement with a newer cleaning device than before the replacement has been performed when the load resistance detected by the load resistance detection device is smaller than the previous load resistance, and determines that replacement with an older cleaning device than before the replacement has been performed when the load resistance is larger than the previous load resistance.

17. The image forming apparatus according to claim 10, wherein the object to be cleaned is a belt that conveys a recording medium.

* * * * *